US009412229B2

(12) United States Patent
Wolf et al.

(10) Patent No.: US 9,412,229 B2
(45) Date of Patent: Aug. 9, 2016

(54) SYSTEM FOR PROVIDING A GAME AT A GAMING MACHINE

(71) Applicant: IGT, Las Vegas, NV (US)

(72) Inventors: Bryan D. Wolf, Reno, NV (US); Dorothy P. Cheung, Reno, NV (US)

(73) Assignee: IGT, Las Vegas, NV (US)

( * ) Notice: Subject to any disclaimer, the term of this patent is extended or adjusted under 35 U.S.C. 154(b) by 329 days.

(21) Appl. No.: 14/222,098

(22) Filed: Mar. 21, 2014

(65) Prior Publication Data

US 2015/0269810 A1 Sep. 24, 2015

(51) Int. Cl.
*G07F 17/00* (2006.01)
*G07F 17/32* (2006.01)

(52) U.S. Cl.
CPC ..... *G07F 17/3225* (2013.01); *G07F 17/3244* (2013.01)

(58) Field of Classification Search
CPC ..... G06F 8/61; G06F 8/60; A63F 2300/552; G07F 17/32; G07F 17/3223; G07F 17/323
See application file for complete search history.

(56) References Cited

U.S. PATENT DOCUMENTS

| | | | | |
|---|---|---|---|---|
| 7,686,688 | B2 | 3/2010 | Friedman et al. | |
| 8,029,367 | B2 * | 10/2011 | Ostergren | A63F 13/12 463/1 |
| 8,403,746 | B2 | 3/2013 | Friedman et al. | |
| 2005/0192099 | A1 * | 9/2005 | Nguyen | G06F 21/10 463/42 |
| 2005/0261062 | A1 * | 11/2005 | Lewin | A63F 13/12 463/42 |
| 2007/0130158 | A1 * | 6/2007 | LaBiche | H04L 29/06027 |

* cited by examiner

*Primary Examiner* — Reginald Renwick
(74) *Attorney, Agent, or Firm* — Neal, Gerber & Eisenberg LLP

(57) ABSTRACT

A server includes a memory, a network interface configured to receive data related to a game available as part of a gaming system, and a processor. The processor is configured to receive the game data via the network interface, determine demand for the game within a gaming environment based on the game data and determine a weighting factor associated with the game based on the demand, and upload the game at one or more gaming machines within the gaming environment based on the weighting factor. The prominence of the game within the gaming environment varies according to the weighting factor.

27 Claims, 5 Drawing Sheets

SYSTEM FOR PROVIDING A GAME AT A GAMING MACHINE

BACKGROUND

In a gaming environment, groups of gaming machines are often dedicated to a single game. If the game is particularly new or popular, a group of machines dedicated to the game may be occupied for long periods of time, such that it may be difficult for a player to use one of the machines in order to play the new or popular game. Players typically are able to locate the group of machines hosting this in-demand game. However, players are often unaware that the in-demand game is also available for play at a nearby multi-game machine. For instance, the in-demand game may not be advertised at the multi-game machine, or the in-demand game may require a download for play at the multi-game machine. As a result, players may seek another game and/or leave the gaming environment.

SUMMARY

An exemplary embodiment relates to a server. The server includes a memory, a network interface configured to receive data related to a game available as part of a gaming system, and a processor. The processor is configured to receive the game data via the network interface, determine demand for the game within a gaming environment based on the game data and determine a weighting factor associated with the game based on the demand, and upload the game at one or more gaming machines within the gaming environment based on the weighting factor. The prominence of the game within the gaming environment varies according to the weighting factor.

Another exemplary embodiment relates to a gaming system for facilitating game play at a gaming machine within a gaming environment. The system includes a network and one or more gaming machines within a gaming environment. Each gaming machine includes a cabinet, a display coupled to the cabinet, and a gaming controller. The system also includes a server configured to communicate with the one or more gaming machines via the network and receive data related to a game available as part of the gaming system via a network interface. The server includes a processing circuit configured to analyze the game data, determine demand for the game within the gaming environment based on the game data and determine a weighting factor associated with the game based on the demand, and upload the game at the one or more gaming machines within the gaming environment based on the weighting factor. The prominence of the game within the gaming environment varies according to the weighting factor.

Another exemplary embodiment relates to a server. The server includes a memory, a network interface configured to receive data related to a game available as part of a gaming system, and a processor. The processor is configured to receive the game data via the network interface, determine demand for the game within a gaming environment based on the game data and determine a weighting factor associated with the game based on the demand, and initiate an attract sequence at one or more gaming machines within the gaming environment. The prominence of the game within the attract sequence varies according to the weighting factor.

BRIEF DESCRIPTION OF THE FIGURES

The details of one or more implementations are set forth in the accompanying drawings and the description below. Other features, aspects, and advantages of the disclosure will become apparent from the descriptions, the drawings, and the claims, in which:

DETAILED DESCRIPTION

Numerous specific details may be set forth below to provide a thorough understanding of concepts underlying the described implementations. It may be apparent, however, to one skilled in the art that the described implementations may be practiced without some or all of these specific details. In other instances, some process steps have not been described in detail in order to avoid unnecessarily obscuring the underlying concept.

A gaming system for providing a game at a gaming machine is described. The system provides the game to the gaming machine based on data related to the game and the gaming machine. The system is intended to provide a popular (e.g., in-demand) game for play at the gaming machine. The system may also be intended to provide an attract sequence that includes features of the game at the gaming machine, such that nearby players are aware that the game is available. The game may be provided based on a determined weighting factor intended to assess demand for a particular game in a particular location. The weighting factor may be applied such that the probability that the game is provided is approximately proportional to demand for the game.

Figure 1:
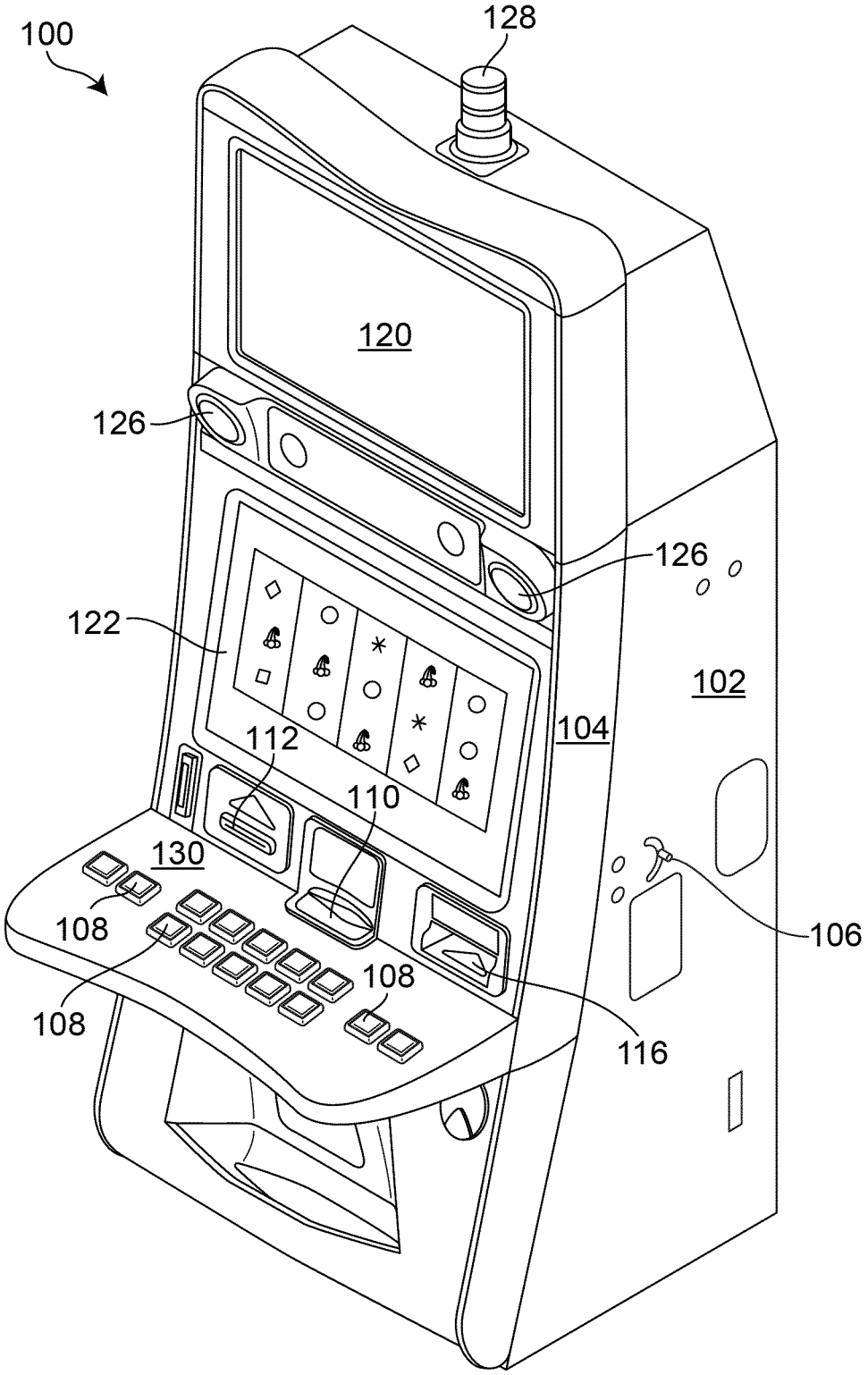
FIG. 1 is a perspective view of a gaming machine for use within the gaming system, according to an exemplary embodiment.

Referring to FIG. 1, a gaming machine 100 (i.e., gaming device) is shown according to an exemplary embodiment. In this embodiment, the gaming machine 100 includes a main cabinet 102. The main cabinet 102 provides a secure enclosure that prevents tampering with device components, such as a game controller (not shown) located within the interior of the main cabinet 102. The main cabinet 102 includes an access mechanism, such as door 104, which allows the interior of the gaming machine 100 to be accessed. Actuation of the door 104 may be controlled by a locking mechanism 106 intended to limit access to the interior of the gaming machine 100. In some embodiments, the locking mechanism, the door 104, and the interior of the main cabinet 102 may be monitored with security sensors of various types to detect whether the interior has been accessed. For instance, a light sensor may be provided within the main cabinet 102 to detect a change in light-levels when the door 104 is opened and/or an accelerometer may be attached to the door 104 to detect when the door 104 is opened.

The gaming machine 100 includes any number of user interface devices that convey sensory information to a user and/or receive input from the user. For example, the gaming machine 100 may include electronic displays 120, 122, speakers 126, and/or a candle device 128 to convey information to the user of the gaming machine 100. The electronic displays 120 and 122 may be a cathode ray tube (CRT) monitor, a liquid crystal display (LCD) monitor, or another type of electronic display suitable for a particular application of the gaming machine 100. In one embodiment, display 120 and/or display 122 may also be a touch screen display configured to receive input from a user. Various embodiments of the gaming machine 100 may also utilize the electronic displays 120 and 122 to provide additional features, such as bonus games and/or attract sequences, to a base game being played on gaming machine 100.

The gaming machine 100 includes a console 130 coupled to the door 104 and having one or more inputs 108 (e.g., buttons, track pads, etc.) configured to receive input from a user. A controller (e.g., game controller) within the gaming machine 100 may run a game, such as a wager-based game, in response to receiving input from a user via the inputs 108 or the display 122. For example, the inputs 108 may be operated to place a wager in the game and to run the game. In response, the controller may execute and display results of the game on displays 120 and 122, such as by causing the reels shown on display 122 to spin (e.g., with a software-based slot game). The controller may also display information related to the game play to the user of the gaming machine 100 via the displays 120 and 122. During the game, the user may view additional game information and/or be presented with additional game options using the electronic display 122. During certain game events, the gaming machine 100 may display visual effects and/or emit audible effects that are perceived by the player in order to add excitement to the game or attract players to the gaming machine 100 (e.g., attract sequences). Visual effects may include flashing lights, strobe lights, and/or other visual effects produced or otherwise displayed by lights (not shown) on the gaming machine 100. Moreover, visual effects may be displayed via patterns on the electronic displays 120 and/or 122. Auditory effects may include various sounds that are projected by the speakers 126.

The gaming machine 100 may also include devices for conducting a wager-based game. For example, the gaming machine 100 may include a ticket acceptor 116 and a printer 110. In various embodiments, the gaming machine 100 may be configured to run on credits that may be redeemed for money and/or other forms of prizes. The ticket acceptor 116 may read an inserted ticket having one or more credits usable to play a game on the gaming machine 100. For example, a player of the gaming machine 100 may wager one or more credits within a slot game. If the player loses, the wagered amount may be deducted from the player's remaining balance on the gaming machine 100. However, if the player wins, the player's balance may be increased by the amount won. Any remaining credit balance on the gaming machine 100 may be converted into a ticket via the printer 110. For example, a player of the gaming machine 100 may cash out of the machine 100 by selecting to print a ticket via the printer 110. The ticket may then be used to play other gaming devices or redeemed for cash and/or prizes. According to various embodiments, the gaming machine 100 may record data regarding its receipt and/or disbursement of credits. For example, the gaming machine 100 may generate accounting data whenever a result of a wager-based game is determined. In some embodiments, the gaming machine 100 may provide accounting data to a remote data collection device, allowing the remote monitoring of the gaming machine 100.

In one embodiment, the gaming machine 100 includes a loyalty card acceptor 112. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing the gaming machine 100. For example, a user having a loyalty account may be given a bonus turn on the gaming machine 100 or credited loyalty points for playing the gaming machine 100. Such loyalty points may be exchanged for loyalty rewards (e.g., a free meal, a free hotel stay, a free room upgrade, discounts, etc.).

Figure 2:
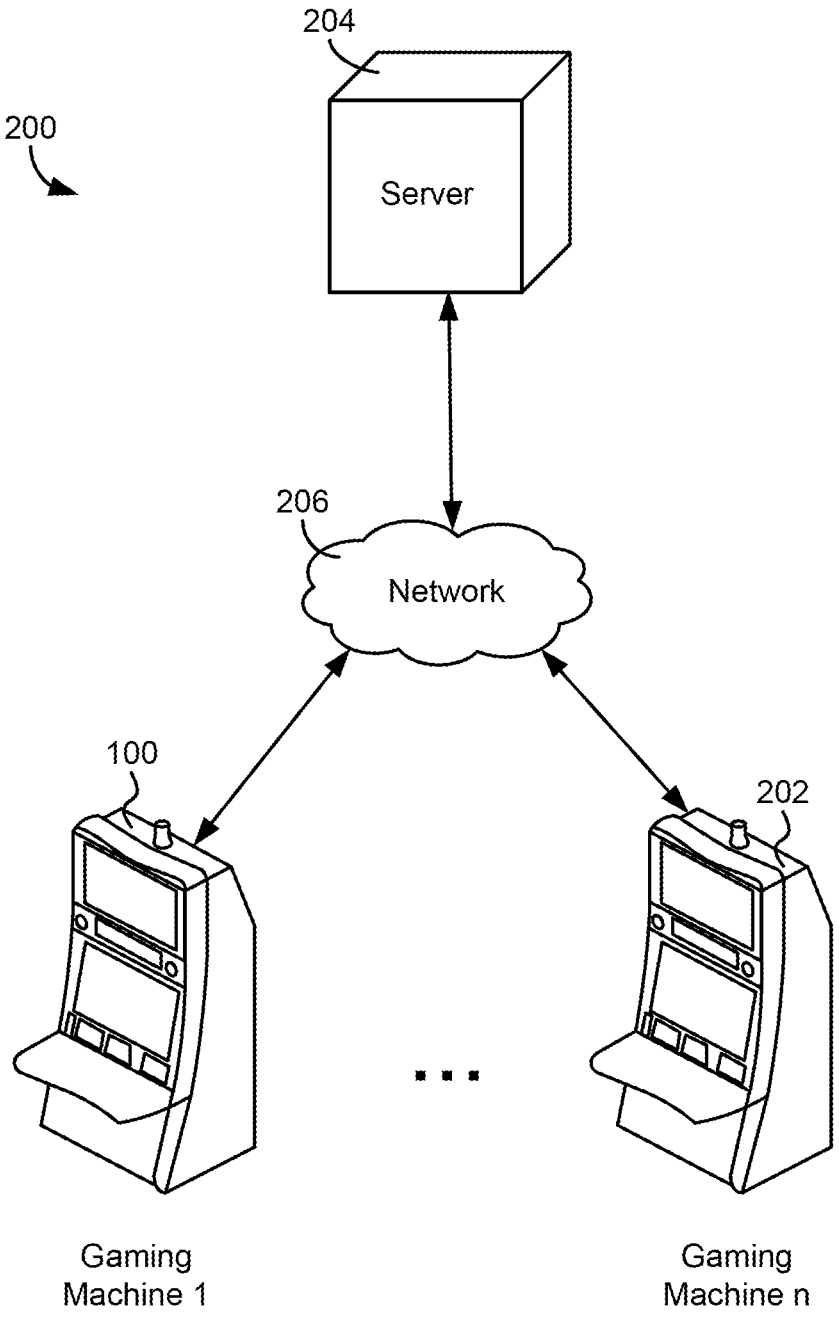
FIG. 2 is a block diagram of the gaming system of the present disclosure, according to an exemplary embodiment.

Referring now to FIG. 2, an illustration of a gaming system 200 is shown, according to an exemplary embodiment. In general, gaming system 200 is configured to allow a player to play instances of one or more wager-based games by providing the wager-based games at a gaming machine (e.g., machine 100) and/or notifying the player that the game is available at a particular gaming machine.

As shown, gaming system 200 may include any number of gaming machines, which may be located physically within one or more entertainment locations, such as casinos, racetracks, bars, etc. For example, gaming system 200 may include gaming machine 100 shown in FIG. 1 through gaming machine 202 (i.e., a first gaming machine through nth gaming machine) on which wager-based games may be played. Gaming system 200 may also include any number of servers and other devices, such as server 204, which support the various functions described herein. The various servers and gaming machines may be located at more than one physical location (e.g., entertainment locations) and configured to communicate remotely as part of the gaming system 200. The gaming system 200 may further include a network 206 through which gaming machines 100, 202 and/or server 204 communicate.

Network 206 may be any form of communications network that conveys data between gaming machines 100, 202 and server 204. In one embodiment, network 206 may also convey data between gaming machines 100, 202. Network 206 may include any number wired or wireless connections, in various embodiments. For example, server 204 may communicate with gaming machines 100, 202 over a wired connection that includes a serial cable, a fiber optic cable, a CAT5 cable, or any other form of wired connection. In another example, server 204 may communicate with gaming machines 100, 202 via a wireless connection (e.g., via WiFi, cellular, radio, etc.). Network 206 may also include any number of local area networks (LANs), wide area networks (WANs), or the Internet. For example, server 204 may communicate with gaming machines 100, 202 via a casino's LAN. Accordingly, network 206 may include any number of intermediary networking devices, such as routers, switches, servers, etc.

In various embodiments, server 204 and gaming machines 100, 202 may utilize a gaming protocol, such as G2S or SAS, to communicate via network 206. Such a gaming protocol may include security features to ensure the integrity of communications between the devices in gaming system 200. For example, a communication between gaming machine 100 and server 204 using G2S may be encrypted using a secure socket layer (SSL) encryption technique. The communication may then be decrypted by the receiving device, thereby ensuring the integrity of the communicated data.

The server 204 may be configured to maintain player loyalty accounts. In general, a loyalty account may include information about the player's identity, rewards or loyalty points earned by the player (e.g., for playing wager-based games, on the player's birthday, etc.), game play data for the player (e.g., games played, amount wagered, types of machines used, etc.), or other such information. For example, a user of gaming machine 100 may link his or her loyalty account to gaming machine 100, so that he or she can gain loyalty points, free turns, etc., while playing gaming machine 100. The server 204 may also be configured to receive data based on the loyalty account used at a particular gaming machine. The server 204 may be configured to perform data analysis based on the loyalty account, such as to determine one or more gaming metrics in part based on the player loyalty accounts.

The server 204 may include a single computing device or a collection of computing devices (e.g., a data center, cloud computing devices, etc.) that communicate via network 206. The server 204 may include one or more processors that execute machine instructions stored in electronic memories. In one embodiment, the server 204 is configured to execute game logic and/or perform other tasks on behalf of the gaming machines 100, 202. For instance, the server 204 may be configured to provide (e.g., load) game content to the gaming machines 100, 202 as part of an interactive game that is playable at the gaming machines 100, 202. The game content may be provided in response to data received from the gaming machines 100, 202, such as in response to input received from a user (e.g., player) of the gaming machines 100, 202. The game content may also be provided in response to data otherwise received at the server 204 as part of the gaming system 200.

In one embodiment, the server 204 is configured to provide a particular game on one of the gaming machines 100, 202 by executing game logic locally and communicating resulting game content to the gaming machines 100, 202 via the network 206. In this embodiment, a portion or all of the game data required for executing the game may be stored at the server 204 or in another storage location outside of the gaming machines 100, 202. The gaming machines 100, 202 may be configured to run a thin client (e.g., Adobe Flash or another such application) for communicating (e.g., displaying) game content provided by the server 204 to the player. For instance, the server 204 may load a particular game to one of the gaming machines 100, 202 by providing the game as a selectable option via the thin client of the gaming machine. The gaming machines 100, 202 are configured to receive input from the player (e.g., via the thin client) and communicate the input to the server 204 using the network 206. Game content provided to the gaming machines 100, 202 may be based on any input received from the player.

In another embodiment, the server 204 is configured to provide a game at one of the gaming machines 100, 202 as downloadable game software. For instance, the server 204 may be configured to provide downloadable software in response to a request received from the player (e.g., via the gaming machines 100, 202) or other input or game data received. In this embodiment, the gaming machines 100, 202 may be configured to download and run the software locally. Once the game is downloaded to the gaming machines 100, 202, the gaming machines 100, 202 (e.g., a processor of the gaming machines 100, 202) may perform a portion or all of the tasks associated with the game, including both executing the game logic and displaying the associated content.

As previously described, the gaming machines 100, 202 may be configured to perform or run an attract sequence intended to attract players to the gaming machines 100, 202. The gaming machines 100, 202 may be instructed to perform the attract sequence by a controller of the gaming machines 100, 202 or remotely from the server 204. The attract sequences may include visual and/or audio effects that are perceivable by players near the gaming machines 100, 202 in order to attract the players to the gaming machines 100, 202. The attract sequences may be tailored to a particular gaming machine or group of gaming machines 100, 202. For instance, the visual effects of the sequence may be provided on a video screen of the gaming machines 100, 202 most visible to a nearby or targeted group of players (e.g., screen 120, screen 122, etc.). Likewise, the audio effects may be provided on speakers of the gaming machines 100, 202 most likely to be heard by the nearby or targeted group of players (e.g., speakers 126).

The server 204 may instruct specific, unoccupied gaming machines to perform an attract sequence based on one or more conditions of the gaming machines. Occupied gaming machines may also perform attract sequences through outputs not being used in the provision of a game to the player occupying the gaming machine. For example, the attract sequence may be displayed on a top box display (e.g., display 120) and other lighting features (e.g., candle 128) to provide both game play and attract functions at the same time.

The attract sequences may be performed by a single gaming machine or multiple gaming machines. The attract sequence may be an individual attract sequence (i.e., independently performed by individual gaming machines) or a coordinated attract sequence amongst multiple gaming machines. For example, during a coordinated attract sequence, gaming machines may alternately light up and make noises as the player moves down a row of gaming machines. The details of the attract sequence triggers and presentations are discussed in further detail below.

The attract sequence may be based on a game currently loaded at the gaming machine (e.g., gaming machine 100). For instance, the attract sequence may be based on the last game played at the gaming machine. The attract sequence may include images and sounds related to the game, such as a jackpot sequence, symbols related to the game, and other effects intended to display one or more aspects of the particular game and/or attract players to the gaming machine 100. In one embodiment, the attract sequence includes each of the games available for play at the gaming machine 100. The games shown within the attract sequence may be those that are available for immediate play at the gaming machine 100 (e.g., stored on the gaming machine, remotely available for play via the server 204, etc.) and/or available for download at the gaming machine (e.g., via server 204). The attract sequence may cycle through aspects of each of the available games (e.g., uniformly, randomly, alternately, etc.), projecting visual and audio effects related to each game as part of the cycle.

Data may be sent between gaming machines 100, 202 and server 204 in real-time (e.g., whenever a game is selected for play, whenever another type of system event occurs, etc.), periodically (e.g., every fifteen minutes, every hour, etc.), or in response to receiving a message from one of the devices. In one embodiment, the gaming machines 100, 202 are configured to send game play data to the server 204, including an accounting of games played at the gaming machines 100, 202. For instance, the server 204 may receive data regarding which games were played and how often, the amount of money wagered on a particular game, the length of each gaming session, payouts of a particular game, etc. The server 204 may also receive location-based data regarding a particular game or gaming machine 100, 202, such as a location of the gaming machine 100, 202 within a particular gaming area and/or a geographic location of the gaming machine 100, 202.

In some cases, the server 204 may be configured to perform data analysis based on data received from the gaming machines 100, 202 or other sources related to the system 200. For example, the server 204 may determine averages, trends, and other gaming metrics related to the wager-based games based on the data received. The server 204 may be configured to dynamically determine which games are the most popular (e.g., overall, within a selected gaming location, within a geographic region, etc.) based on the data received. The server 204 may also be configured to dynamically determine which games are the most "desired" based on the data, such as by determining a percentage of available machines on which a particular game is being played (e.g., wherein supply of a game does not meet demand). The server 204 may also be configured to, based on the data received, determine any of the gaming metrics described herein relative to a particular location, such as a selected gaming location (e.g., gaming machine, bank of gaming machines, gaming area or location, etc.) or a geographic region.

The server 204 may be configured to load or provide a particular game for play at one of the gaming machines 100, 202 based on the data received. The server 204 may also be configured to provide the attract sequence to the gaming machines 100, 202 based on the data (e.g., based on the games available at the machines 100, 202). In one embodiment, the server 204 is configured to assign a weight (i.e., weighting factor) to each game based on the data. The server 204 may then provide the games for play or within an attract sequence to the gaming machines 100, 202 based on the weighting factor. In this way, the weighting factor may be used to offer players more options to find and play a particular game, such as those games which are most popular or in-demand. For instance, the weighting factor may be related to a probability that a particular game is provided for play or included within an attract sequence, with games having a greater weighting factor being provided for play or included within an attract sequence with greater frequency than games having a lower weighting factor. In one embodiment, the games are provided to the gaming machines 100, 202 and/or included within the attract sequences randomly based on the assigned probability (e.g., the weighting factor). In another embodiment, the games and the attract sequences are manipulated by the server 204 so that each game is approximately represented within the system 200 according to the corresponding weighting factor.

In one embodiment, the weighting factor is based on demand for a particular game. The server 204 may be configured to determine the demand for each game (e.g., the game's popularity) based on the data. Games having greater demand may be assigned a greater weighting factor, and thus be provided (e.g., for play, within an attract sequence, etc.) at more of the gaming machines 100, 202. For instance, the weighting factor may be based on how often the game has been played within a particular time period, such as within the last day, week, or month. The weighting factor may also be determined based on how often the game has been downloaded within a particular time period. The weighting factor may also be based on how often the game has been played per gaming machine on which the game is available for play, the time length of each gaming session for the particular game, or how often gaming machines providing the game are in use. The weighting factor may also be based on the game's percentage of game play within a particular gaming location or across gaming system 200, or based on other data intended to assess the popularity or demand for a particular game.

The weighting factor may also be based on the newness of a particular game. The server 204 may be configured to determine a newness of each game based on the data. Games that are newer may be assigned a greater weighting factor such that those games are provided at more of the gaming machines 100, 202. For instance, the weighting factor may be based on a release date of the game, with games having a later release date being more likely to be provided at the gaming machines 100, 202. The weighting factor may also be based on how long the game has been available at a particular gaming location or within a particular geographic region. The weighting factor may also be based on how long a new version of a particular game has been available for play, or based on other data intended to assess the newness of a particular game.

The weighting factor may also be based on a payout provided by a particular game. For instance, games that provide greater payouts may be assigned a greater weighting factor. The weighting factor may be based on recent payouts for a particular game, such as recent payouts within a particular gaming location or across the gaming system 200. The weighting factor may also be based on a jackpot for a particular game. For instance, a greater weighting factor may be assigned to a particular game when a progressive jackpot reaches a higher payout. The weighting factor may also be based on payouts of a particular game at nearby gaming machines. For instance, if a large payout is achieved on a particular game at a particular gaming machine, the weighting factor for that game at nearby machines may be increased in order to provide the game to nearby gaming machines (and nearby players). In other embodiments, the weighting factor may be based on other data related to payout of a particular game and/or a particular location.

As noted above, the weighting factor may also be based on a particular gaming machine. In one embodiment, the weighting factor assigned to each game may be modified as applied to a particular gaming machine, such that the weighting factor (i.e., a modified weighting factor) is based on both the game and the gaming machine. The weighting factor may be modified to place more importance on characteristics or data related to either the game or the gaming machine, depending on the particular application of the gaming system 200. Each of the gaming machines 100, 202 may be assessed by the server 204 individually, or the gaming machines 100, 202 may be assessed in groups according to location, function, etc. Data related to the gaming machines 100, 202 may be received by the server 204 from one or more components of the gaming system 200, including the gaming machines 100, 202. The data may also be received manually (e.g., via a programmer or service technician of the server 204 and/or the gaming machines 100, 202).

In one embodiment, the weighting factor may be based on the location of a particular gaming machine. In this embodiment, the weighting factor may be based on a location of the gaming machine within a particular gaming environment. For instance, the weighting factor may be based on the proximity of the gaming machine to other gaming machines within the environment, as well as proximity to other landmarks within the gaming environment, such as location entrances, restrooms, cashiers, table games, etc. In one embodiment, the weighting factor is based on proximity to single-game gaming machines dedicated to a particular game. For instance, if the game at the single-game machines is popular at the time, the server 204 may be more likely to provide this game at the nearby gaming machine. The weighting factor can also be based on visibility of the gaming machine from the popular bank of gaming machines. Gaming machines facing the popular bank or having video screens that are visible from the popular bank may be more likely to provide the game that is available at the popular bank of machines (e.g., may have a greater weighting factor for this particular game).

The weighting factor may also be based on the type of environment in which the gaming machine is located. For instance, the weighting factor may be based on whether the gaming machine is located within a casino, a hotel, a retail location, etc. The weighting factor may also be based on the geographic location of the gaming machine. For instance, the weighting factor may be modified if a particular game is more popular or more in-demand in a particular geographic location than in another location. The weighting factor may also be modified based on the content of the game in relation to the geographic location of the gaming machine.

The weighting factor may also be based on the particular player at the gaming machine. For instance, the server 204 may be configured to receive data related to a player loyalty account and determine the types of games preferred by the player at the gaming machine. The weighting factor may then be based on games or types of games preferred by the particular player. Based on the weighting factor, the server 204 may be configured to provide certain games for play at that gaming machine or display an attract sequence for one or more games at an adjacent gaming machine. For a new player (e.g., a player without a loyalty account or with an unused loyalty account), the weighting factors may be unbiased or may be based on other factors described herein (e.g., demand for a particular game).

The weighting factor may also be based on a particular date and/or time. For instance, the weighting factor for a particular game may be modified based on the time of day (e.g., morning, afternoon, evening, late night, etc.) or at certain time intervals throughout the day (e.g., hourly, every six hours, every twelve hours, etc.). The weighting factor may also be modified depending on a day of the week or a particular time period (e.g., weekdays vs. weekends, during three-day weekends, etc.). The weighting factor may also be modified depending on the time of year (e.g., by season, according to holidays, etc.). In one embodiment, the game data includes game play data for each game according to the particular date and/or time. The weighting factors for each game are then based on the game play data and the current date and/or time. For instance, if a game is particularly popular during the evening, the weighting factor for that game may be increased during the evening so that the game is available and/or is advertised at more gaming machines. The weighting factor may be similarly modified based on any of the herein described date and/or time designations.

Based on the weighting factor, the server 204 may be configured to automatically provide one or more games to one or more of the gaming machines 100, 202. For instance, the server 204 may be more or less likely to automatically upload one or more games (e.g., cause a gaming machine to download) or provide one or more games as a player selection and host game play via the network 206 based on the weighting factor. The server 204 may also be more or less likely to select or modify an attract sequence for the one or more gaming machines 100, 202 based on the weighting factor, such as to include features of or otherwise promote a particularly popular or in-demand game.

In one embodiment, the weighting factor for each game may include an upper and/or a lower limit. For instance, a weighting factor for a particular game may have an upper limit (e.g., a maximum weighting factor) such that the game is not overrepresented at a particular gaming machine or within a gaming system. The upper limit may correspond to a maximum percentage of the attract sequence which is dedicated to a particular game, or to a maximum percentage of gaming machines within a gaming system at which the game is downloaded and available for play. Likewise, the weighting factor may have a lower limit (e.g., a minimum weighting factor) such that the game is minimally represented at the gaming machine or within the gaming system (e.g., such that the game maintains some presence within the gaming system 200 regardless of popularity).

The weighting factors may be updated dynamically (i.e., according to each event within the gaming system 200), by schedule (e.g., each hour, each day, etc.), and/or manually (e.g., by an operator or technician responsible for the system 200). The content provided by the gaming machines 100, 202 may likewise be updated based on the changing weighting factors. For instance, the games and/or the attract sequences provided at the gaming machines 100, 202 may be automatically updated periodically based on the current weighting factors. The game content may also be updated manually to reflect the current weighting factors.

Each weighting factor may represent a suggested percentage or ratio for the presence of a particular game within the gaming system 200. In one embodiment, the sum of all weighting factors within the gaming system 200 (or within a particular location of the system 200) is equal to 1.0 (i.e., 100 percent). In this embodiment, for instance, a game having a weighting factor of 0.1 may be uploaded or otherwise available for play on approximately 10 percent of the available gaming machines 100, 202. Likewise, the game may be similarly represented within the attract sequences shown within the gaming system 200.

The weighting factor may also represent a multiplier. For instance, a game having a weighting factor of two (2) may be weighted twice as heavily within the gaming system 200 as an average game. This game may thus have twice the probability of being provided on one of the gaming machines 100, 202 within the system 200 as an average game. The game may also have twice the probability of being represented within an attract sequence of the system 200 as an average game. Similarly, a game having a weighting factor of 0.5 may be half as likely to be provided on one of the gaming machines 100, 202 or represented within the attract sequence as an average game in this embodiment.

In other embodiments, the weighting factor may be otherwise used (e.g., by the server 204) to determine which games to provide and/or advertise at the gaming machines 100, 202 within the gaming system 200. The weighting factor may be a number, a symbol, or another designation intended to represent a probability that a particular game is loaded or advertised at a particular gaming machine of the system 200. The weighting factor may be automatically determined (e.g., by the server 204) or subject to manual manipulation by an operator or technician granted access to the gaming system 200. The game content may be automatically provided to the gaming machines 100, 202 within the system 200 (e.g., by the server 204) based on the weighting factor and/or the weighting factor may be provided to an operator or technician for manually pushing or providing game content to the gaming machines 100, 202.

Figure 3:
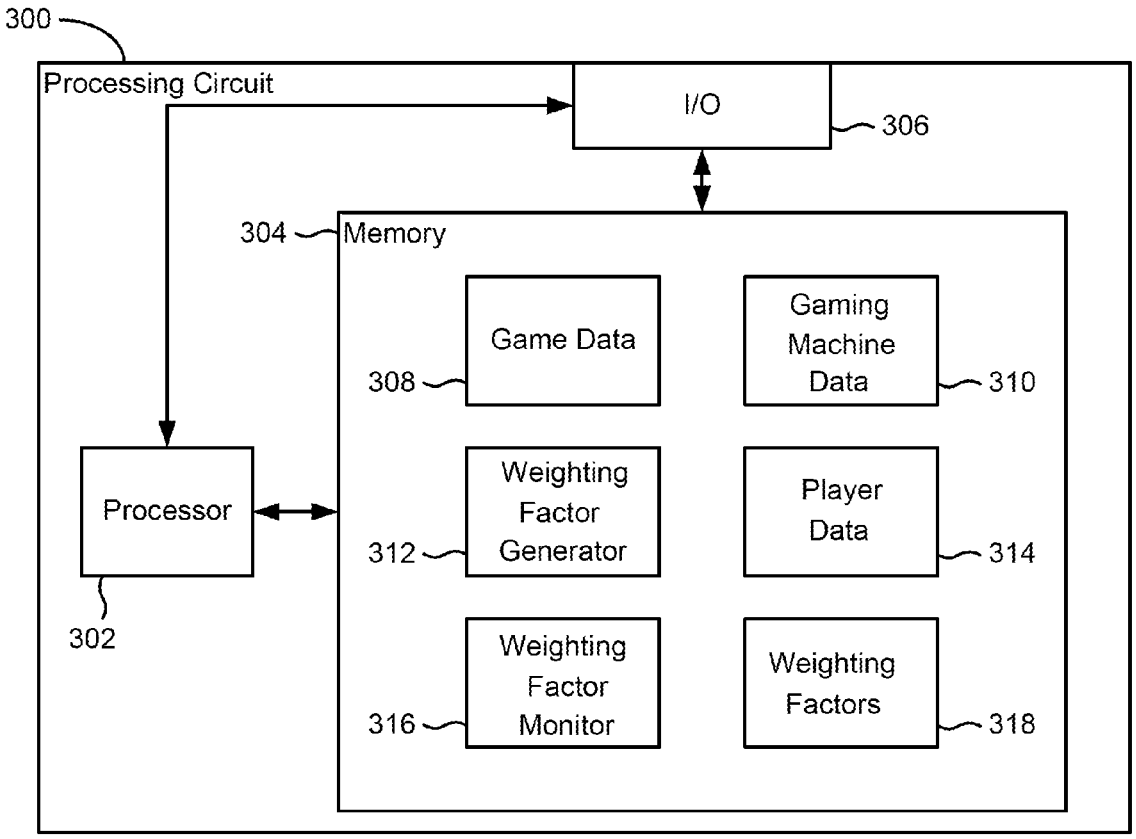
FIG. 3 is a block diagram of a processing circuit, according to an exemplary embodiment.

Referring now to FIG. 3, a block diagram of a processing circuit 300 is shown, according to an exemplary embodiment. Processing circuit 300 may be a processing component of any electronic device used as part of a gaming environment. For example, any of server 204 and gaming machines 100, 202 may include processing circuit 300. In another embodiment, processing circuit 300 may be part of a computing system that includes multiple devices. In such a case, processing circuit 300 may represent the collective components of the system (e.g., processors, memories, etc.). For example, server 204 in communication with gaming machine 100 may form a processing circuit configured to perform the operations described herein.

Processing circuit 300 may include a processor 302 and a memory 304. Memory 304 stores machine instructions that, when executed by processor 302, cause processor 302 to perform one or more operations described herein. Processor 302 may include a microprocessor, FPGA, ASIC, any other form of processing electronics, or combinations thereof. Memory 304 may be any electronic storage medium such as, but not limited to, a floppy disk, a hard drive, a CD-ROM, a DVD-ROM, a magnetic disk, RAM, ROM, EEPROM, EPROM, flash memory, optical memory, or combinations thereof. Memory 304 may be a tangible storage medium that stores non-transitory machine instructions. Processing circuit 300 may include any number of processors and memories. In other words, processor 302 may represent the collective processing devices of processing circuit 300 and memory 304 may represent the collective storage devices of processing circuit 300. Processor 302 and memory 304 may be on the same printed circuit board or may be in communication with each other via a bus or other form of connection.

I/O hardware 306 includes the interface hardware (e.g., a network interface) used by processing circuit 300 to receive data from other devices and/or to provide data to other devices. For example, a command may be sent from processing circuit 300 to a controlled device of gaming machine 100 via I/O hardware 306. I/O hardware 306 may include, but is not limited to, hardware to communicate on a local system bus and/or on a network. For example, I/O hardware 306 may include a port to transmit display data to an electronic display and another port to receive data from any of the devices connected to network 206 shown in FIG. 2.

Processing circuit 300 may store game data 308 in memory 304. In general, game data 308 includes information about the operation of games provided at any number of electronic devices (e.g., gaming machines 100, 202) within the gaming system 200. Example data in game data 308 may include information regarding which game is being played, the amount wagered by a player in a round of gameplay of the game, which in-game events occur during the round of gameplay (e.g., the player receives three aces, the player has a full house, etc.), the results of the round (e.g., the amount won or lost by the player), or any other information regarding the operation of the game. Game data 308 may also include information related to the game, such as when the game was provided to the gaming machines 100, 202, the date the game was introduced, and other characteristics of the game. Game data 308 may be specific to one type of wager-based game (e.g., a specific type of video poker, video slot, etc.) or may include game data for any number of different games. In one embodiment, game data 308 is received via I/O hardware 306 from the devices. For example, processing circuit 300 may receive data regarding a round of gameplay on a gaming machine. In another embodiment, game data 308 is generated locally in memory 304. For example, if processing circuit 300 provides a thin client game to a device, game data 308 may be generated locally in memory 304 during execution of the game logic.

Memory 304 may store gaming machine data 310 which identifies the gaming machines 100, 202 within the gaming system 200 and includes information related to the gaming machines 100, 202, such as a location of the gaming machines 100, 202 (e.g., location type, geographic location, etc.), gaming capabilities (e.g., storage capacity, video displays, gaming capabilities, etc.), and data related to machine usage. The gaming machine data 310 may be used to determine one or more weighting factors within the gaming system 200.

Memory 304 may store player data 314 which identifies players of the one or more games associated with game data 308. Player data 314 may include information to identify an individual player, such as the player's name, phone number, address, contact information, or the like. In one embodiment, player data 314 corresponds to loyalty accounts held by individual patrons of a gaming establishment and/or online gaming service. For example, a player of a gaming machine may identify himself or herself by swiping a loyalty card, using a biometric reader, entering a screen name, or the like. Based on the information provided by the player, the player's account may be associated with the corresponding game data 308 for the player. For example, the player may earn loyalty points in his or her account based on game play.

In various embodiments, memory 304 includes a weighting factor generator 312 configured to generate weighting factors 318. Weighting factor generator 312 is configured to generate any number of weighting factors for use in providing games to the gaming machines 100, 202 based on game data 308, gaming machine data 310, and/or player data 314. The weighting factor generator 312 may be configured to generate weighting factors 318 for each game available within the gaming system 200. Weighting factor generator 312 may also be configured to generate weighting factors 318 for each gaming machine 100, 202 within the system 200 according to each available game. Weighting factor generator 312 may store any weighting factors in weighting factors 318 and provide an indication of the created weighting factor to a weighting factor monitor 316.

Memory 304 may also include weighting factor monitor 316, which is generally configured to monitor the game data 308, the gaming machine data 310, and the player data 314 and modify or update the weighting factors 318 based on any of the data received. On creation of a new weighting factor by weighting factor generator 312, weighting factor monitor 316 may receive an indication of the newly created weighting factor. In response, weighting factor monitor 316 may monitor the gaming system 200 using the data 308, 310, and 314 and update the weighting factors 318 based on the data. The weighting factor monitor 316 may be configured to update the weighting factors 318 periodically or otherwise, as is described above.

Figure 4:
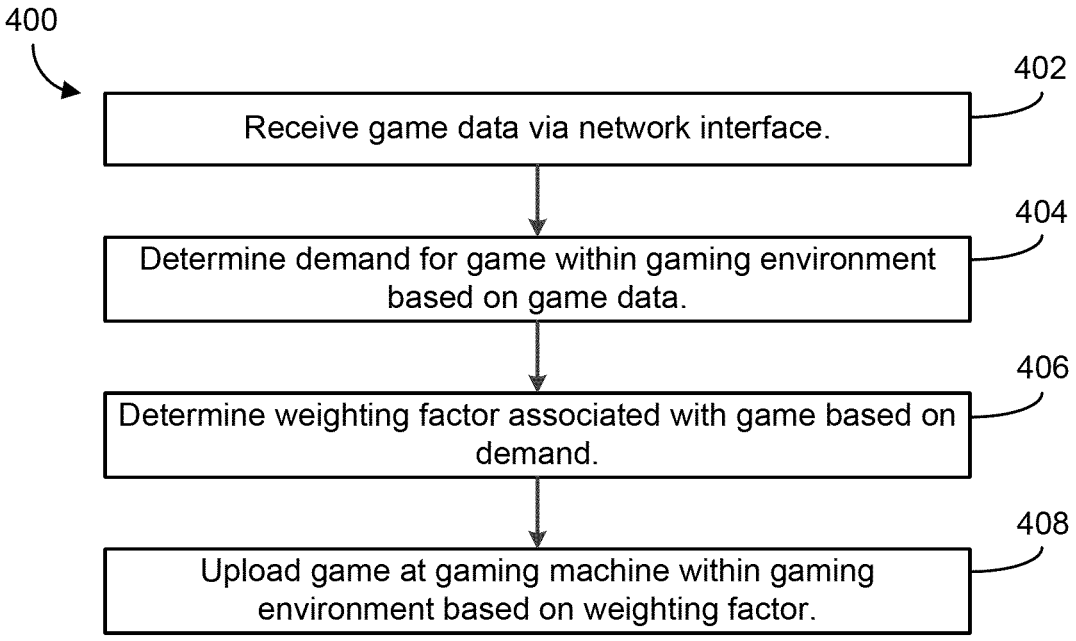
FIG. 4 is a flow chart diagram of a process for providing a game at a gaming machine, according to an exemplary embodiment.

Referring now to FIG. 4, a process 400 for providing (e.g., uploading) a game at a gaming machine (e.g., gaming machine 100) is shown, according to an exemplary embodiment. The process 400 may be executed by a processor (e.g., 302) as part of a processing circuit. The process 400 may be executed by any of the server 204, the gaming machines 100, 202, and/or the processing circuit 300.

At 402, game data related to an available game (e.g., a game available as part of the gaming system 200) is received. The game data may be received by the processing circuit 300 via a network interface (e.g., I/O hardware 306). The game data may be received from a gaming machine (e.g., gaming machines 100, 202) located within a gaming environment, such as a casino. The game data may include a location of one or more gaming machines. The game data may also be related to a particular available game. For instance, the game data may include data regarding which gaming machines within the gaming environment have the game downloaded and available for play at the machine. The game data may also include data related to the newness of a game, including a game release date or a date when the game became available for play within the gaming environment or at a particular machine. The game data may also include accounting data for a particular game and/or gaming machine, including the number of times a game has been played or the amount wagered on a particular game. The game data may also include recent payouts for a particular game or a jackpot amount available within a particular game at any time. The data may be received periodically or upon request.

At 404, demand for the game within the gaming environment is determined based on the game data. For instance, the processor 302 may be configured to determine game play rates for a particular game, such as a percentage of gaming machines within a gaming environment having the game downloaded and available for play. Demand may also be determined based on a percentage of these machines which are currently occupied or occupied within a particular time period. At 406, a weighting factor associated with the game is determined based on the demand. The weighting factor may be used to determine which games to upload to the gaming machines within the gaming environment.

At 408, the game may be uploaded (e.g., by the processor 302) to one or more gaming machines within the gaming environment based on the weighting factor. For instance, the processing circuit 300 may be configured to send the game (e.g., data related to the game) to the one or more gaming machines via the network 206. The gaming machines may download the game at the gaming machines (e.g., to a memory or other storage at the gaming machines). The game may be stored at the one or more gaming machines and available for immediate play at the gaming machines. In other embodiments, the game may be otherwise provided to the one or more gaming machines. For instance, the server 204 may host the game (e.g., at least a portion of the game data may be stored at the server 204) and the server 204 may provide the game for immediate play at the one or more gaming machines via the network 206.

Figure 5:
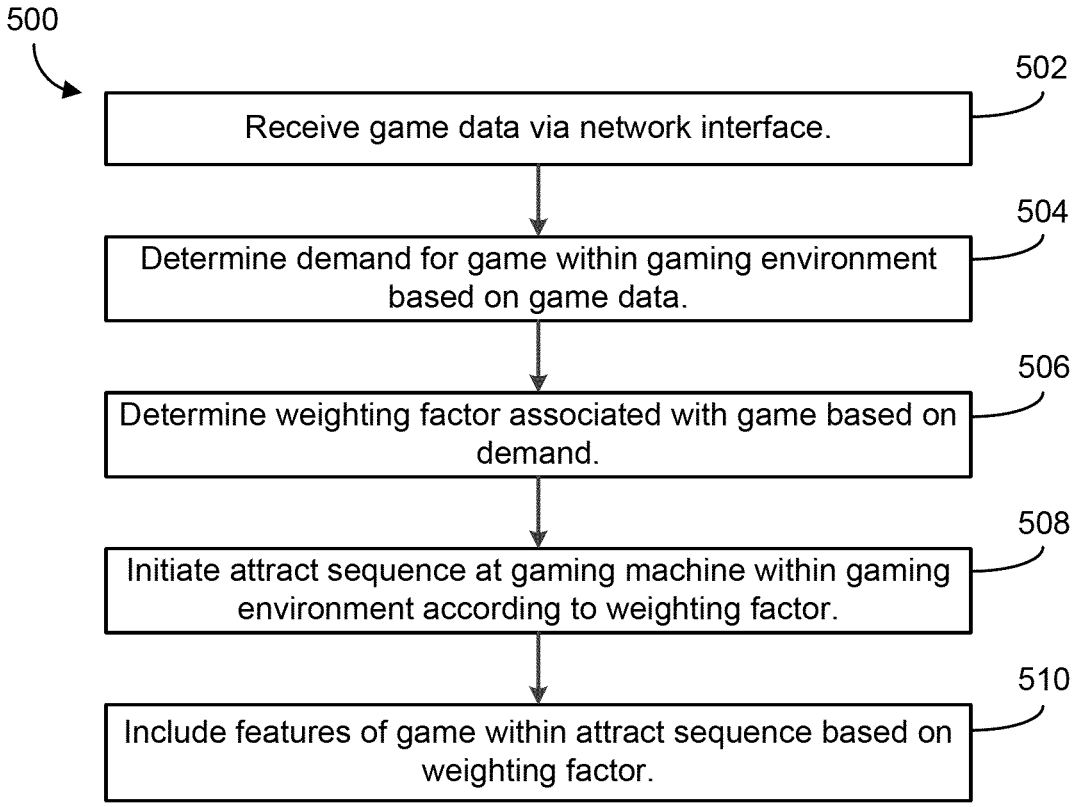
FIG. 5 is a flow chart diagram of a process for providing an attract sequence at a gamine machine, according to an exemplary embodiment.

Referring now to FIG. 5, a process 500 for providing an attract sequence at a gaming machine is shown, according to an exemplary embodiment. The process 500 may be executed by a processor such as processor 302 as part of a processing circuit (e.g., circuit 300). For instance, the server 204 may include a processor configured to execute the process 500 within a gaming system.

Process 500 is similar to process 400 and any of the remarks made above in reference to process 400 may apply similarly to process 500. For instance, at 502, game data related to an available game is received, such as via a network interface. At 504, demand for a particular game within a gaming environment is determined based on the game data. At 506, a weighting factor associated with the particular game is determined based on demand for the game.

At 508, an attract sequence is initiated at one or more gaming machines within a gaming environment according to the weighting factor. The attract sequence may include elements of particular game, such as sounds, visuals, and other features. The attract sequence may be at least partially displayed on a display of the gaming machines (e.g., display 120, 122). For instance, each of the gaming machines within the gaming environment may display an identical attract sequence based on the demand and/or the weighting factor for the particular environment. In one embodiment, the attract sequence at a particular gaming machine is based on the available games at adjacent or nearby gaming machines and the particular gaming machine's proximity to the other available games (i.e., the gaming machines at which the games are available). The attract sequence may also be otherwise provided and/or modified in accordance with the present disclosure, such as is described above in reference to the attract sequence. At 510, the attract sequence may be initiated or provided to include features of the game based on the weighting factor. For instance, the game features displayed within the attract sequence may be proportioned according to the weighting factor.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines (EGMs); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

In various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, a gaming system may include a plurality of EGMs that are each configured to communicate with a central server, central controller, or a remote host through a data network.

In certain embodiments in which the gaming system includes an EGM in combination with a central server, central controller, or remote host, the central server, central controller, or remote host is any suitable computing device (such as a server) that includes at least one processor and at least one memory device or storage device. The EGM may include at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T−1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs).

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (e.g., main cabinet 804 shown in FIG. 8). In other embodiments, at least one of the at least one processor of the EGM and the at least one memory device of the EGM reside outside the cabinet of the EGM.

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

In various embodiments, the EGM includes one or more input devices. The input devices may include any suitable device that enables an input signal to be produced and received by the at least one processor of the EGM. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. It should be appreciated that, in some embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display decreases by one, and a number of credits shown in a bet display increases by one.

In other embodiments, one input device of the EGM is a cash out device. The cash out device is utilized to receive a cash payment or any other suitable form of payment corresponding to a quantity of remaining credits of a credit display.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are inputted to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, one input device of the EGM is a card reader in communication with the at least one processor of the EGM. The card reader is configured to read a player identification card inserted into the card reader.

In various embodiments, the EGM includes one or more output devices (e.g., display 810 shown in FIG. 8). One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status; (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. In another such embodiment, the EGM provides dynamic sounds coupled with attractive multimedia images displayed on one or more of the display devices to provide an audiovisual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. In various embodiments, the primary game(s) and the secondary game(s) may comprise any suitable games and/or wagering games, such as, but not limited to: electro-mechanical or video slot or spinning reel type games; video card games such as video cribbage, video draw poker, multi-hand video draw poker, other video poker games, video blackjack games, and video baccarat games; video keno games; video bingo games; and video selection games.

In certain embodiments in which the secondary game or the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. In certain embodiments, one or more of the reels are independent reels or unisymbol reels. In such embodiments, each independent reel generates and displays one symbol.

In certain such embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617, 151; and 8,057,298 describe various examples of player tracking systems.

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on one or more computer storage medium for execution by, or to control the operation of, data processing agent. Alternatively or in addition, the program instructions can be encoded on an artificially-generated propagated signal (e.g., a machine-generated electrical, optical, or electromagnetic signal) that is generated to encode information for transmission to suitable receiver agent for execution by a data processing agent. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing agent on data stored on one or more computer-readable storage devices or received from other sources.

The term "client or "server" include all kinds of agent, devices, and machines for processing data, including by way of example a programmable processor, a computer, a system on a chip, or multiple ones, or combinations, of the foregoing. The agent can include special purpose logic circuitry, e.g., an FPGA (field programmable gate array) or an ASIC (application-specific integrated circuit). The agent can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The agent and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and agent can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube), LCD (liquid crystal display), OLED (organic light emitting diode), TFT (thin-film transistor), plasma, other flexible configuration, or any other monitor for displaying information to the user and a keyboard, a pointing device, e.g., a mouse, trackball, etc., or a touch screen, touch pad, etc., by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending webpages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

What is claimed is:

1. A server, comprising:

a memory;

a network interface configured to receive data related to a game available as part of a gaming system; and a processor configured to:

receive the game data via the network interface;

determine demand for the game within a gaming environment based on the game data and determine a weighting factor associated with the game based on the demand; and upload the game at one or more gaming machines within the gaming environment based on the weighting factor;

wherein the prominence of the game within the gaming environment varies according to the weighting factor.

2. The server of claim 1, wherein the probability that the game is uploaded to one of the one or more gaming machines is proportional to the weighting factor.

3. The server of claim 1, wherein the processor is further configured to initiate an attract sequence at the one or more gaming machines, and wherein the attract sequence is configured to include features of the game based on the weighting factor.

4. The server of claim 3, wherein the attract sequence is also based on proximity of the one or more gaming machines to another gaming machine at which the game is provided.

5. The server of claim 1, wherein the game data includes data related to a newness of the game, and wherein the demand is determined based on the newness.

6. The server of claim 1, wherein the game data includes an accounting of game play of the game relative to other games available as part of the gaming system, and wherein the demand is determined based on the game play data.

7. The server of claim 1, wherein the game data includes data related to a payout of the game, and wherein the demand is determined based on the payout.

8. The server of claim 1, wherein the weighting factor is determined based on a location of the one or more gaming machines.

9. The server of claim 1, wherein the gaming environment is a casino.

10. A gaming system for facilitating game play at a gaming machine within a gaming environment, the system comprising:

a network;

one or more gaming machines within a gaming environment, each gaming machine comprising:

a cabinet;

a display coupled to the cabinet; and a gaming controller; and a server configured to communicate with the one or more gaming machines via the network and receive data related to a game available as part of the gaming system via a network interface, the server including a processing circuit configured to analyze the game data, determine demand for the game within the gaming environment based on the game data and determine a weighting factor associated with the game based on the demand, and upload the game at the one or more gaming machines within the gaming environment based on the weighting factor, and wherein the prominence of the game within the gaming environment varies according to the weighting factor.

11. The system of claim 10, wherein the probability that the game is uploaded to one of the one or more gaming machines is proportional to the weighting factor.

12. The system of claim 10, wherein the processor is further configured to initiate an attract sequence via the display of the one or more gaming machines, and wherein the attract sequence is configured to include features of the game based on the weighting factor.

13. The system of claim 12, wherein the attract sequence is based on proximity of the one or more gaming machines to another gaming machine at which the game is provided.

14. The system of claim 10, wherein the game data includes data related to a newness of the game, and wherein the demand is determined based on the newness.

15. The system of claim 10, wherein the game data includes an accounting of game play of the game relative to other games available within the gaming environment, and wherein the demand is determined based on the game play data.

16. The system of claim 10, wherein the game data includes data related to a payout of the game, and wherein the demand is determined based on the payout.

17. The system of claim 10, wherein the weighting factor is determined based on a location of the one or more gaming machines.

18. The system of claim 10, wherein the gaming environment is a casino.

19. A server, comprising:

a memory;

a network interface configured to receive data related to a game available as part of a gaming system; and a processor configured to:

receive the game data via the network interface;

determine demand for the game within a gaming environment based on the game data and determine a weighting factor associated with the game based on the demand; and initiate an attract sequence at one or more gaming machines within the gaming environment, wherein the prominence of the game within the attract sequence varies according to the weighting factor.

20. The server of claim 19, wherein the processor is further configured to include particular features of the game within the attract sequence based on the weighting factor.

21. The server of claim 19, wherein the content provided within the attract sequence that is related to the game is directly proportional to the weighting factor.

22. The server of claim 19, wherein the attract sequence is based on proximity of the one or more gaming machines to another gaming machine at which the game is provided.

23. The server of claim 19, wherein the game data includes data related to a newness of the game, and wherein the demand is determined based on the newness.

24. The server of claim 19, wherein the game data includes an accounting of game play of the game relative to other games available as part of the gaming system, and wherein the demand is determined based on the game play data.

25. The server of claim 19, wherein the game data includes data related to a payout of the game, and wherein the demand is determined based on the payout.

26. The server of claim 19, wherein the weighting factor is determined based on a location of the one or more gaming machines.

27. The server of claim 19, wherein the gaming environment is a casino.

* * * * *